US007386921B2

(12) United States Patent
Kojima

(10) Patent No.: US 7,386,921 B2
(45) Date of Patent: Jun. 17, 2008

(54) SLIDER FOR CONCEALED TYPE SLIDE FASTENER

(75) Inventor: Masayoshi Kojima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/599,735

(22) Filed: Nov. 15, 2006

(65) Prior Publication Data

US 2007/0107171 A1 May 17, 2007

(30) Foreign Application Priority Data

Nov. 16, 2005 (JP) ..... 2005-330997

(51) Int. Cl.
*A44B 19/26* (2006.01)

(52) U.S. Cl. ..... 24/427; 24/432

(58) Field of Classification Search ..... 24/415, 24/426–428, 432

See application file for complete search history.

(56) References Cited

U.S. PATENT DOCUMENTS 3,011,251 A * 12/1961 McNamara ..... 29/408
4,000,546 A 1/1977 Takamatsu
5,956,819 A * 9/1999 Terasaki et al. ..... 24/432

FOREIGN PATENT DOCUMENTS

JP 50-25855 8/1975

* cited by examiner

*Primary Examiner*—James R Brittain
(74) *Attorney, Agent, or Firm*—Alston & Bird LLP

(57) ABSTRACT

A slider for a concealed type slide fastener for securing a smooth sliding operation even if a strong laterally pulling force is applied when the slide fastener is closed. The slider includes: a lower plate having a pair of flanges each having an inverted L shaped section, the flanges erected along right and left side edges perpendicular to a sliding direction of the slider; a diamond erected toward a gap between upper plate portions of the pair of flanges from a central portion of the lower plate; and element guide portions expanded outwardly toward inside end faces of the upper plate portions from an outer periphery of the diamond, wherein the front ends of the upper plate portion in an engagement direction of the fastener elements are extended forward compared with front end of the element guide portion.

6 Claims, 9 Drawing Sheets

SLIDER FOR CONCEALED TYPE SLIDE FASTENER

BACKGROUND OF THE INVENTION

1. Field of the Invention

The invention relates to a slider for a concealed type slide fastener in which a main body of the slider as an opening/closing device is not exposed outside when the slide fastener is closed, and more particularly, to a slider for a concealed type slide fastener which enables a smooth sliding operation even if a strong lateral pulling force is applied when the slide fastener is closed.

2. Description of the Related Art

Conventionally, this kind of the concealed type slide fastener has been often used for women's clothes, and in recent years, has advanced into other fields, for example, a field of passenger seat of automobile and train. In the passenger seat, its cushion body formed integrally with a frame in advance is covered with a seat cover. At this time, the dimensions of the seat cover are set smaller than the dimensions of the cushion body, so that the seat cover can cover the cushion body in a compressed state to suppress generation of looseness or deformation in the appearance shape as much as possible. Additionally, when a passenger is seated on the seat, the passenger seat is deformed elastically so as to correspond to a load distribution of the human body easily, and when he or she leaves the seat, it returns to its original shape, thereby preventing the seat from loosing its shape.

Usually, the seat cover comprises a sheet produced by uniting a surface skin layer, a thin elastic intermediate layer, and a rear face base fabric layer into a laminate by lamination processing, the surface skin layer constituted of natural leather or synthetic leather or woven or knitted fabric having various structures, the thin elastic intermediate layer constituted of a polyurethane foamed body sheet or the like, and the rear face base fabric layer constituted of a thin woven or knitted fabric obtained by weaving or knitting extremely fine threads. Usually, plural sheet pieces are cut from such a sheet so as to correspond to the shape of a passenger seat, and then, these sheet pieces are sewed together three-dimensionally in combination so as to produce a seat cover. However, if the entire seat cover is produced by sewing, the seat cover often cannot be applied to the cushion body of a seat having a complicated shape. Thus, conventionally, a portion not sewed is prepared, and after the seat cover is applied to the cushion body, the portion not sewed is sewed by hand.

However, the sewing by hand likely produces a difference in quality of a completed product or sewing time, because of a difference in skill of a sewing worker. Thus, in recent years, the slide fastener has been often used in part of the sewed portion of the seat cover, for example, along a bead portion, and particularly, a concealed type slide fastener whose slider main body is not exposed outside has been often used, in order to eliminating the hand sewing. As a result, all sewing operations can be carried out with a sewing machine, so that conventional faults based on a difference of skill are reduced largely, thereby leading to improvement of production efficiency.

In the concealed type slide fastener, as disclosed in for example, Japanese Patent Application Publication No. 50-25855, a pair of right and left first flanges each having an inverted L shaped section are provided along side edges of a lower plate of the slider body, the side edges being perpendicular to a slider sliding direction. The pair of first flanges comprise straight portions parallel as seen in a plan view, and expanded portions which are continued from the straight portions and expanded curvedly such that they depart from each other. A diamond having a substantially elliptic horizontal section is provided upwardly in a vertical direction at an end portion on an expanded side of the lower plate. A second flange is formed integrally on a top face of the diamond, and a gate-like pull tab attaching post is formed integrally on a top face of the second flange such that it extends in a sliding direction.

A pull tab is mounted onto the pull tab attaching post such that it can rotate freely back and forth in the sliding direction. The second flange comprises a substantially rectangular plate portion provided so as to be extended outwardly such that it surrounds a periphery of the diamond, and a wedge-like plate portion which is continued from the rectangular plate portion and provided so as to be extended toward a gap between the straight portions of the first flange with its front end formed sharply. Here, an opening at the end portion on a diamond side is called a shoulder mouth, and an opening on the opposite side to the diamond is called a rear mouth. A space formed by the first flange, the diamond and the second flange serves as a guide passage for a coupling element row, and a space formed between the first flange and the second flange serves as a guide gap for the fastener tape.

On the other hand, in fastener stringers in which a slider having such a configuration is inserted, a number of coupling elements are attached by sewing along opposing side edges of the pair of fastener tapes with coupling heads located inside, respectively. Element attachment edge portions of the pair of fastener stringers obtained in this way are folded back into a U shape such that the coupling heads of the coupling elements project outwardly along the element attachment edge portions. The folded shape is fixed by thermal setting. The slider is loaded on the pair of fastener stringers having such a structure, with the coupling heads of the elements opposing each other, from the shoulder mouth of the slider, and in addition, the folded portion of the fastener tape extended out from a tape guide gap between the first and second flanges, so that the slider is inserted in the fastener stringers to complete a concealed type slide fastener.

When the conventional concealed type slide fastener with the slider inserted therein, the slider having the above-described configuration, is applied to a seat cover of a passenger seat of an automobile or the like, and finally the slide fastener is closed, a strong laterally pulling force is applied to the fastener stringer in the vicinity of the slider because the seat cover is formed in a smaller dimension than the external dimension of the cushion body. The strong laterally pulling force raises the coupling element row due to a structure specific to the above-described concealed type slide fastener. Particularly in the conventional slider, the second flange having substantially the same thickness as the first flange is extended from the end face on the shoulder mouth of the diamond to the right and left side faces.

Each element to be introduced to the shoulder mouth while receiving a laterally pulling force at a portion near the shoulder mouth of the second flange is raised until it is substantially at right angle with respect to the tape face of the fastener tape. Until the connecting portion of each element rides over the top face of the lower plate of the slider, the element is introduced into an element guide passage of the slider in advance and receives a tilting by a preceding element tilted by contact with the first flange, the diamond and the upper plate portion of the second flange, and a relative pulling force of the fastener tape based on the sliding operation of the slider.

For this reason, a connecting portion of each element is often nipped in between the first and second flanges because the element is not tilted sufficiently when the connecting portion of each element rides over the top face of the lower plate of the slider, thereby disabling the sliding of the slider. If attempt is made to try to slide the slider forcibly, not only the element is damaged by the laterally pulling force, but also the folded edge of the fastener tape can be broken.

Particularly, the phenomenon that the element is nipped as described above is often found in concealed type slide fastener with independent elements in which respective elements are attached independently to an element attachment edge portion of a fastener stringer by injection molding. If speaking specifically, for example, in a concealed type slide fastener in which coil-like elements are attached to the fastener stringers, the respective elements are formed continuously with the elements located back and forth. For this reason, when the slider is slid, each element receives a force of tilting by a preceding element introduced into an element guide passage of the slider in advance.

However, a concealed type slide fastener in which respective elements are formed independently has such a problem that the element is nipped in between the first flange and the second flange because an influence of a tilting force applied to each element by a preceding element is small and the tilting of each element is very small.

SUMMARY OF THE INVENTION

The invention has been achieved to solve these conventional disadvantages, and an object of the invention is to provide a slider for a concealed type slide fastener which, when applied to a seat cover of a passenger seat, secures a smooth sliding operation even if a strong laterally pulling force is applied when the slider fastener is closed.

To achieve the above-described object, the invention provides a slider for a concealed type slide fastener, the slider engaging/disengaging fastener elements of a pair of fastener stringers in which side edges opposing each other of fastener tapes are bent and fixed into a U shape and the fastener elements are attached along bent edges of the side edges, wherein the slider includes a lower plate; a pair of flanges each having an inverted L shaped section, the flange comprising right and left side wall portions erected along side edges of the lower plate in a right and left direction perpendicular to a sliding direction of the slider and right and left upper plate portions extending from the top ends of the right and left side wall portions in a direction of approaching each other; a diamond erected from a central portion in a right and left direction near a shoulder mouth of the lower plate so as to be directed to a gap between the right and left upper plate portions; and element guide portions expanded outwardly toward inside end faces of the right and left upper plate portions from an outer periphery of the diamond, and wherein the front ends of the upper plate portions in an engagement direction of the fastener element are extended forward, compared with front ends of the element guide portions.

According to a preferred embodiment, the upper plate portions comprise: parallel portions in which the right and left inside end faces opposing each other are formed substantially in parallel along the engagement direction; and narrowed portions which extend backward of the parallel portions, in which a gap between the right and left inside end faces decreases gradually as it goes backward in the engagement direction.

According to the invention, preferably, the element guide portions are expanded symmetrically in a right and left direction from the diamond toward the right and left upper plate portions, thickness of the element guide portions in the right and left direction temporarily and gradually increases as it goes from a front end to a rear end in the engagement direction, side edges of the element guide portions come close to the inside end faces of the parallel portions of the upper plate portions, and then, the thickness decreases gradually so that the side edges of the element guide portions become parallel to the inside end faces of the narrowed portions of the upper plate portions, the element guide portions have: intersection lines which are tilted or curved such that the thickness of the element guide portions decreases gradually as it goes downward in a height direction and which intersect with right and left side faces of the diamond; and guide faces each formed on the bottom portions of the element guide portions, from front ends to rear end in the engagement direction, along the intersection lines, and the intersection lines are formed such that the heights thereof with respect to the top face of the lower plate decreases gradually as they go from the front ends to the rear ends in the engagement direction.

In this case, preferably, a border of the inside end faces between the parallel portions and the narrowed portions of the upper plate portions is located backward in the engagement direction, compared with a straight line connecting side edges of the element guide portions where the thickness of the element guide portions in the right and left direction is at maximum.

Further, in the slider for the concealed type slide fastener of the invention, it is preferable that a height of the intersection lines at the front ends in the engagement direction of the element guide portions from the top face of the lower plate is set larger than a height of the bottom faces of the upper plate portions.

Preferably, the inside corner portions opposing each other at the front ends and rear ends in the engagement direction of the right and left upper plate portions are curved.

In the slider for the concealed type slide fastener of the invention, as described above, the front ends in the engagement direction of the upper plate portions of the pair of flanges erected along the right and left side edges of the lower plate extend forward, compared with front end of the element guide portions expanded from the outer periphery of the diamond erected from the central portion of the lower plate. The engagement direction mentioned in the invention refers to a moving direction of moving the slider when engaging right and left elements in the concealed type slide fastener. By moving the slider forward in the engagement direction, the right and left elements are introduced out from the rear mouth of the slider in an engaged state (closed state).

For example, in case of a concealed type slide fastener attached to a seat cover which covers a passenger seat of automobile or the like, an extremely strong laterally pulling force is applied to a fastener tape when the fastener is closed. Thus, each of the fastener elements to be introduced successively into an element guide passage of the slider, the element guide passage formed by a lower plate having flanges, a diamond and an element guide portion, is raised with respect to the tape face of the fastener tape at a position apart in a forward direction in the engagement direction from the slider, with the coupling head side of the element up.

In the concealed type slide fastener having the conventional slider, when each element is introduced into an element guide passage of the slider, each element receives an effect of a tilting force by a preceding element already introduced into the element guide passage and tilted, and a relative pulling force of the fastener tape based on the sliding operation of the slider. Accordingly, when each element advances into the element guide passage of the slider, it can be caught by the flanges of the slider because it is not tilted completely although it is tilted slightly, and consequently, the sliding of the slider is often stopped.

Contrary to this, in the slider of the invention, the front ends of the upper plate portions in the engagement direction extend forward, compared with the front end of the element guide portions. For this reason, the element is guided with keeping a contact with the upper plate portion extended forward compared with the front end of the element guide portion even if it is raised at right angle with its coupling head located up at a position apart forward in the engagement direction from the slider. As a result, the element receives an effect of a tilting force by a preceding element in a tilted condition and a relative pulling force of the fastener tape based on the sliding operation of the slider. Consequently, the right and left elements appropriately tilt the elements raised at right angle by the time when they advance into the element guide passage of the slider, and at the same time, bring the elements close to the diamond to bring the coupling heads of the elements into a contact with the element guide portions.

The respective elements tilted appropriately are introduced into the element guide passage of the slider with their coupling heads kept in contact with the element guide portion, and then moved smoothly through the element guide passage toward the rear mouth side while the coupling heads of the elements are tilted gradually to a posture of submerging below the element guide portion, so that the right and left elements can be engaged in a proper posture (coupling posture) in which they are tilted completely. Therefore, the elements are kept from being caught by the flanges of the slider as often occurred conventionally, thereby preventing the element and the fastener tape from being damage and broken, respectively, so that the concealed type slide fastener can be closed without any trouble by a smooth sliding operation of the slider.

This kind of slider of the invention can be applied very effectively to not only a concealed type slide fastener with continuous elements in which coil-like elements are attached, but also a concealed type slide fastener with independent elements in which respective elements are attached independently while conventionally, the element has been often caught by the flange.

In the slider for the concealed type slide fastener of the invention, the right and left upper plate portions comprise parallel portions in which the right and left inside end faces are substantially parallel to each other and narrowed portions in which an interval between the right and left inside end faces decreases gradually as it goes backward in the engagement direction. As a result, the elements can be tilted appropriately by the parallel portions of the upper plate portions before they are introduced into the element guide passage of the slider, and at the same time, the coupling heads of the elements can be brought into a secure contact with the element guide portions. Further, after the elements are introduced into the element guide passage, the fastener tape passes between the narrowed portion of the upper plate portion and the element guide portion. Then, the right and left elements are tilted more and approach each other as they move through the element guide passage. After the elements pass through the element guide portions, the right and left elements can be engaged with each other in a stable engagement posture.

According to the present invention, the element guide portions are expanded symmetrically to both the right and left sides of the diamond, and the thickness in the expanding direction of the element guide portions temporarily and gradually increases as it goes from the front end to the rear end, and then, it decreases gradually. After the side edges of the element guide portions approach the parallel portions of the upper plate portions, and then, they become parallel to the narrowed portions of the upper plate portions. Each of the element guide portions has an intersection line which intersects with the side face of the diamond at the bottom of the element guide portion. The intersection line is formed such that the height thereof to the top face of the lower plate decreases gradually as it goes from the front end to the rear end. Further, the bottom portion of the element guide portion has a guide face running along the intersection line. Particularly, the guide face is formed such that the expanding direction to the right or left directions from the intersection line approaches in a parallel condition to the top face of the lower plate as it goes toward the rear end in the engagement direction.

The element guide portions have the above-described configuration. Accordingly, the elements introduced smoothly into the element guide passage of the slider are guided to the guide faces of the element guide portions and can be tilted completely to an engagement posture halfway to the rear mouth, and immediately after the elements pass through the rear end of the element guide portions, they can be engaged with mating elements securely.

In this case, the border of the inside end faces between the parallel portions and the narrowed portions of the upper plate portions is located backward in the engagement direction with respect to a straight line connecting the side edges of the element guide portions in which the thickness of the element guide portions in the right and left direction is at maximum. As a consequence, the elements can be brought into a secure contact with the element guide portions and introduced smoothly into the element guide passage, so that the right and left elements can be engaged with each other stably.

In the slider for the concealed type slide fastener of the present invention, the height of the intersection line at the front end of the element guide portion in the engagement direction is set above the height of the bottom face of the upper plate portion. As a consequence, when the elements are introduced into the element guide passage, the coupling heads of the elements can be brought into a secure contact with the element guide portions.

Further, according to the present invention, the inside corner portions opposing each other at the front end and rear end of the right and left upper plate portions in the engagement direction are curved. Accordingly, the elements or the fastener tape can be prevented from being caught by the upper plate portions even if the slider is slid in a state in which the fastener stringers are receiving strong laterally pulling force, thereby achieving a smooth sliding operation of the slider.

DESCRIPTION OF THE PREFERRED EMBODIMENTS

Hereinafter, typical embodiments of the invention will be described in detail with reference to the accompanying drawings.

Figure 1:
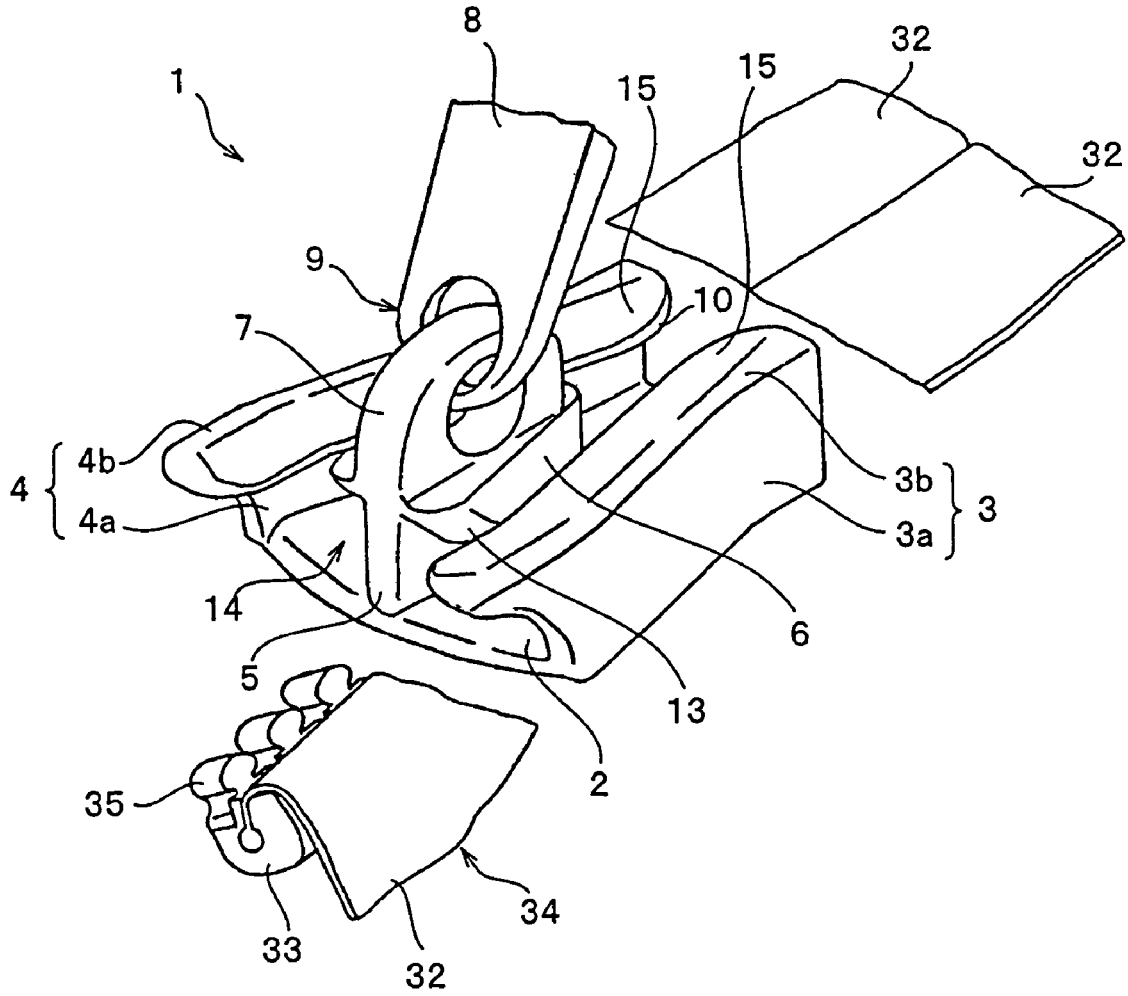
FIG. 1 is a perspective view of a slider for a concealed type slide fastener according to a first embodiment of the invention as seen from obliquely upward.
Figure 2:
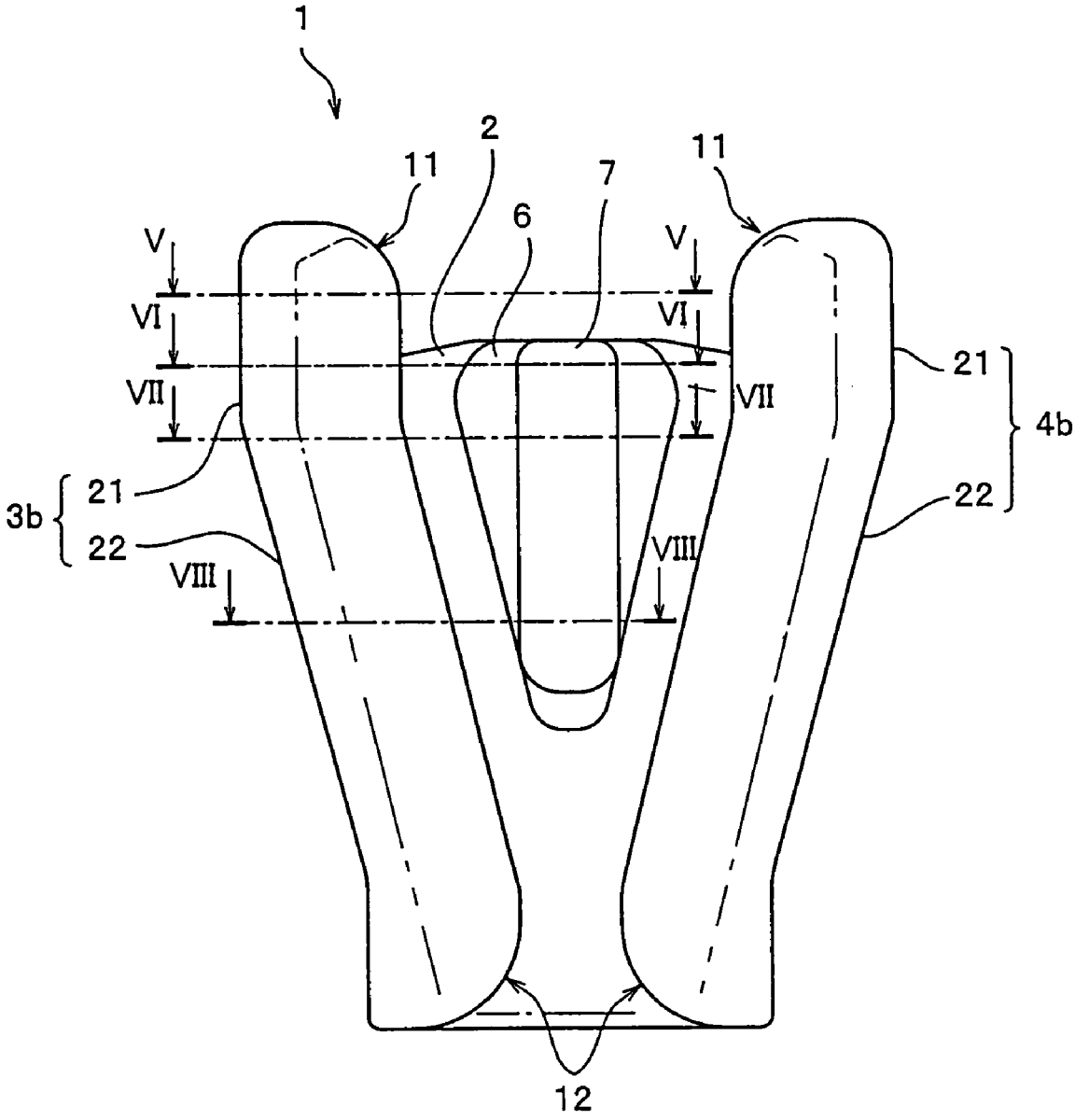
FIG. 2 is a front view of the slider.
Figure 3:
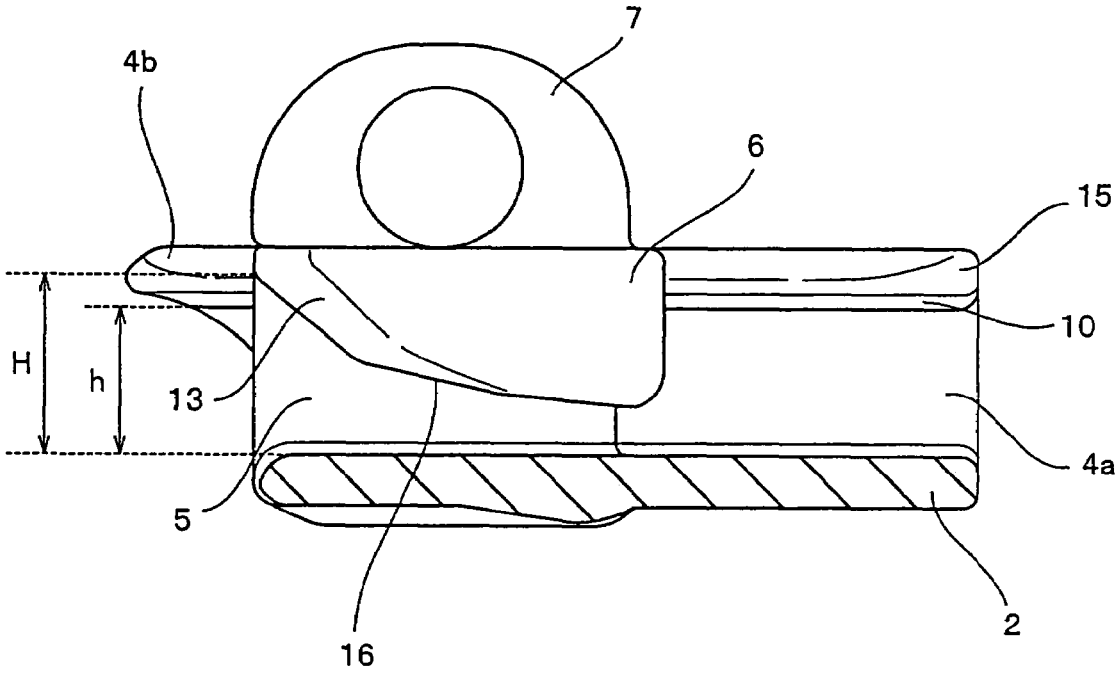
FIG. 3 is a partial sectional view of the slider as seen from sideway.

FIG. 1 is a perspective view of a slider for a concealed type slide fastener according to a first embodiment of the present invention as seen from obliquely upward. FIG. 2 is a front view of the slider, and FIG. 3 is a partial sectional view of the slider as seen from sideway.

The slider 1 according to the first embodiment comprises: a lower plate 2 including flanges 3, 4 each having an inverted L shaped section erected vertically along side edges in the right and left direction perpendicular to a sliding direction of the slider 1; a diamond 5 erected upward from the central portion of the lower plate 2; element guide portions 6 expanded outwardly from the outer periphery of the diamond 5; a gate-like pull tab attaching post 7 extending in the sliding direction on the top face of the diamond 5; and a pull tab 8 supported by the pull tab attaching post 7 freely rotatably through an annular portion 9 at one end portion of the pull tab.

The front end of the lower plate 2 in an engagement direction is formed substantially circularly. The size of the lower plate 2 in the width direction (right and left direction) perpendicular to the sliding direction is reduced gradually from its front edge up to a position slightly behind the rear end of the diamond 5, and further formed in the same width from the position to the edge on the rear mouth side. The pair of flanges 3, 4 each having an inverted L shaped section are erected on the right and left side edges of the lower plate 2 having such a shape along the sliding direction of the slider 1. The flanges 3, 4 have symmetrical shapes to each other, which comprise side wall portions 3*a*, 4*a* erected upward from the side edges of the lower plate 2 and upper plate portions 3*b*,4*b* extending inwardly and curvedly from the top ends of the right and left side wall portions 3*a*, 4*a*. The respective upper plate portions 3*b*, 4*b* have inside end faces 10 opposing each other.

According to the first embodiment, the front ends of the right and left side walls 3*a*, 4*a* in the engagement direction are curved such that they project forward as they go from the lower plate 2 of the lower position to the upper plate portions 3*b*, 4*b* of the upper position. Further, the front ends of the upper plate portions 3*b*, 4*b* in the engagement direction project forward relative to the front ends of the element guide portions 6. At this time, the front ends of the upper plate portions 3*b*, 4*b* are preferred to extend forward relative to the front ends of the element guide portions 6 by a length not shorter than the dimension of a single one of fastener elements 33 attached to a concealed type slide fastener 31 using the slider 1.

Tapered faces 15 are formed on the top face of the upper plate portions 3*b*, 4*b* on the right and left sides from the front end to the rear end of the upper plate portions 3*b*, 4*b* such that the thickness thereof decreases gradually as it goes toward the inside end face 10. The bottom faces of the upper plate portions 3*b*, 4*b* are formed parallel to the top face of the lower plate 2. Further, curved portions 11 are formed on inside opposing corner portions at the front ends of the upper plate portions 3*b*, 4*b* on the right and left sides by chamfering. In addition, curved portions 12 are formed on inside opposing corner portions at the rear ends by chamfering more than at the front ends.

The right, left upper plate portions 3*b*, 4*b* are comprised of a parallel portion 21 disposed on the front side in the engagement direction, and narrowed portion 22 disposed on the rear side. The parallel portion 21 is disposed to be directed forward from a position behind the front end of the element guide portion 6 in the engagement direction, and the right and left inside end faces 10 are formed substantially in parallel along the sliding direction of the slider 1. The narrowed portions 22 are extended such that they are bent from the rear ends of the parallel portions 21, and a gap between the right and left inside end faces 10 decreases gradually as it goes backward.

According to the first embodiment, the diamond 5 is erected from the central portion of the lower plate 2 such that it extends between the right and left upper plate portions 3*b*, 4*b*, and has a substantially rectangular horizontal section while the front end in the engagement direction coincides with the front end of the lower plate 2 in the central portion.

The element guide portion 6 is expanded from the outer periphery of the diamond 5 outwardly toward the inside end faces 10 of the upper plate portions 3*b*, 4*b* such that its right and left portions are symmetrical with respect to the engagement direction. A gap which allows a fastener tape 32 to pass therethrough is secured between the side edge of the element guide portion 6 and the inside end face 10 of each of the right and left upper plate portions 3*b*, 4*b*.

The thickness of each of the right and left element guide portions 6 in the extending direction, as shown in FIG. 2, temporarily and gradually increases as seen in its plan view as it goes from the front end to the rear end in the engagement direction, so that the side edge of the element guide portion 6 approaches the inside end face 10 of the upper plate portion 3*b*, 4*b*. Thereafter, the thickness of the element guide portion 6 decreases gradually from a position near the front end relative to the border between the parallel portion 21 and the narrowed portion 22 of the upper plate portions 3*b*, 4*b* as it goes toward the rear end of the element guide portion 6. In other words, the border on the inside end face 10 between the parallel portion 21 and the narrowed portion 22 of the upper plate portion 3*b*, 4*b* of the slider 1 is located backward in the engagement direction relative to a line which connects the side edges in which the thickness of the element guide portion 6 in the right and left direction becomes maximum. The side edge in which the thickness of the element guide portion 6 decreases gradually as it goes toward the rear end is formed substantially in parallel to the inside end face 10 of the narrowed portion 22 of each of the upper plate portions 3*b*, 4*b*.

Figure 4:
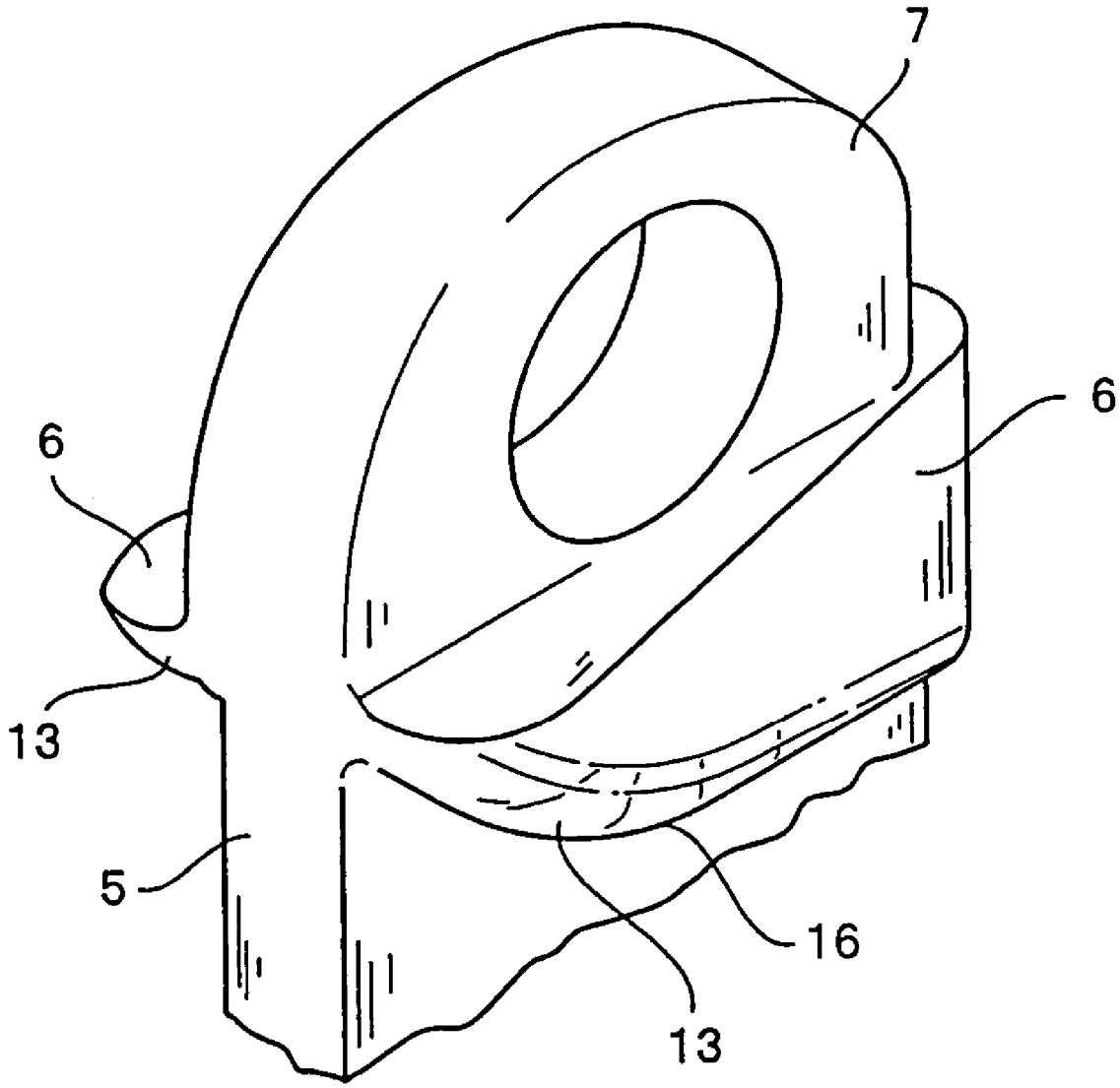
FIG. 4 is a partial perspective view showing enlarged element guide portions.
Figure 5:
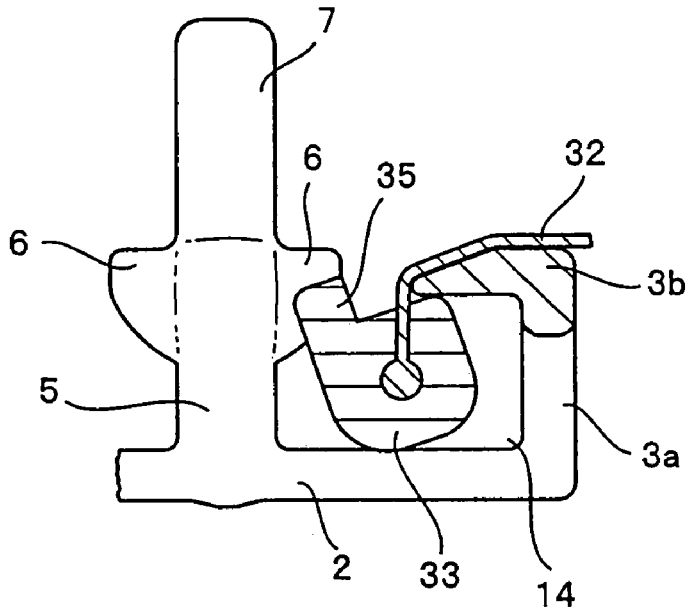
FIG. 5 is a sectional view taken along the line V-V of FIG. 2 when the slider shown in FIG. 2 is loaded on an element row of a fastener stringer.
Figure 6:
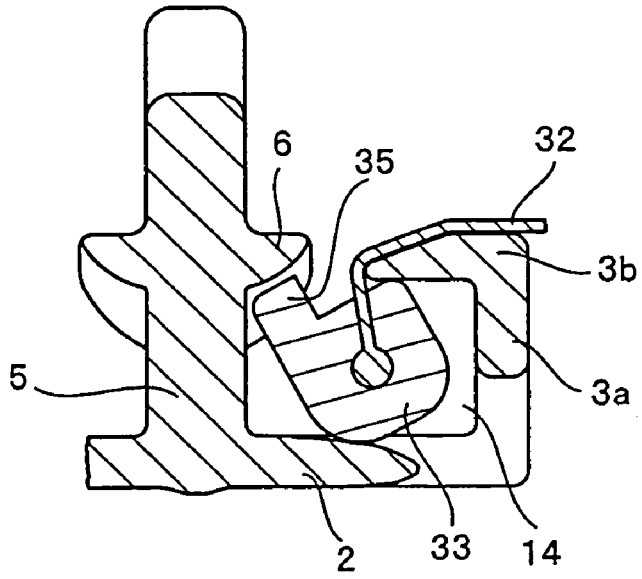
FIG. 6 is a sectional view taken along the line VI-VI of FIG. 2 when the slider shown in FIG. 2 is loaded on the element row of the fastener stringer.

The element guide portion 6 is curved such that the thickness thereof decreases gradually as it goes downward in the height direction. The element guide portion 6 has an intersection line 16 which intersects the right and left side faces of the diamond 5 at the bottom end of the element guide portion 6 in a direction to the lower blade portion 2, as shown in FIGS. 3 and 4. The intersection line 16 is formed from the front end to the rear end in the engagement direction such that its height from the top face of the lower plate portion 2 decreases gradually. The bottom portion of the element guide portion 6 has a guide face 13 along the intersection line 16. The guide face 13 is inclined gradually such that the direction of the extension in the right and left direction on the intersection line 16, in other words, the direction of a tangent line on the guide face 13 in the extending direction on the intersection line 16 approaches a parallel condition to the top face of the lower plate 2 as it goes toward the rear end in the engagement direction.

That is, the guide face 13 in the vicinity of the intersection line 16 is inclined largely with respect to the top face of the lower plate 2 on the front end side of the element guide portion 6. The inclination of the guide face 13 in the vicinity of the intersection line 16 is changed such that it approaches a parallel condition to the top face of the lower plate 2 as it goes near to the rear end of the element guide portion 6.

The guide face 13 of the first embodiment is formed in a curved face in which the thickness of the element guide portion 6 is increased gradually as it goes upward from the intersection line 16. However, the present invention is not restricted thereto. For example, the guide face 13 may be an inclined face which is inclined in a tapered shape as it goes upward from the intersection line 16 of the element guide portion 6. Further, the inclination angle may be changed gradually such that inclined face approaches a parallel condition to the top face of the lower plate 2 as it approaches the rear end of the element guide portion 6.

In the slider 1 of the first embodiment, a substantially Y shaped space formed by the lower plate 2, the flanges 3, 4 erected on the right and left side edges of the lower plates 2, the diamond 5 and the element guide portion 6 serves as a guide passage 14 which allows the elements 33 attached to a fastener stringer 34 to pass therethrough.

The height of the intersection line 16 at the front end in the engagement direction in the element guide portion 6 is set above the height of the bottom face of the upper plate portion 3, 4. That is, a height H from the position of the intersection line 16 at the front end of the element guide portion 6 to the top face of the lower plate 2 is set larger than a height h from the position of the bottom face of the upper plate portion 3, 4 to the top face of the lower plate 2, as shown in FIG. 3. Consequently, when the elements 33 attached to the concealed type slide fastener 31 are introduced into the element guide passage 14 of the slider 1, the elements 33 can be tilted gradually to their engagement posture with their coupling heads 35 of the elements 33 brought into a firm contact with the guide face 13 of the element guide portion 6.

Figure 9:
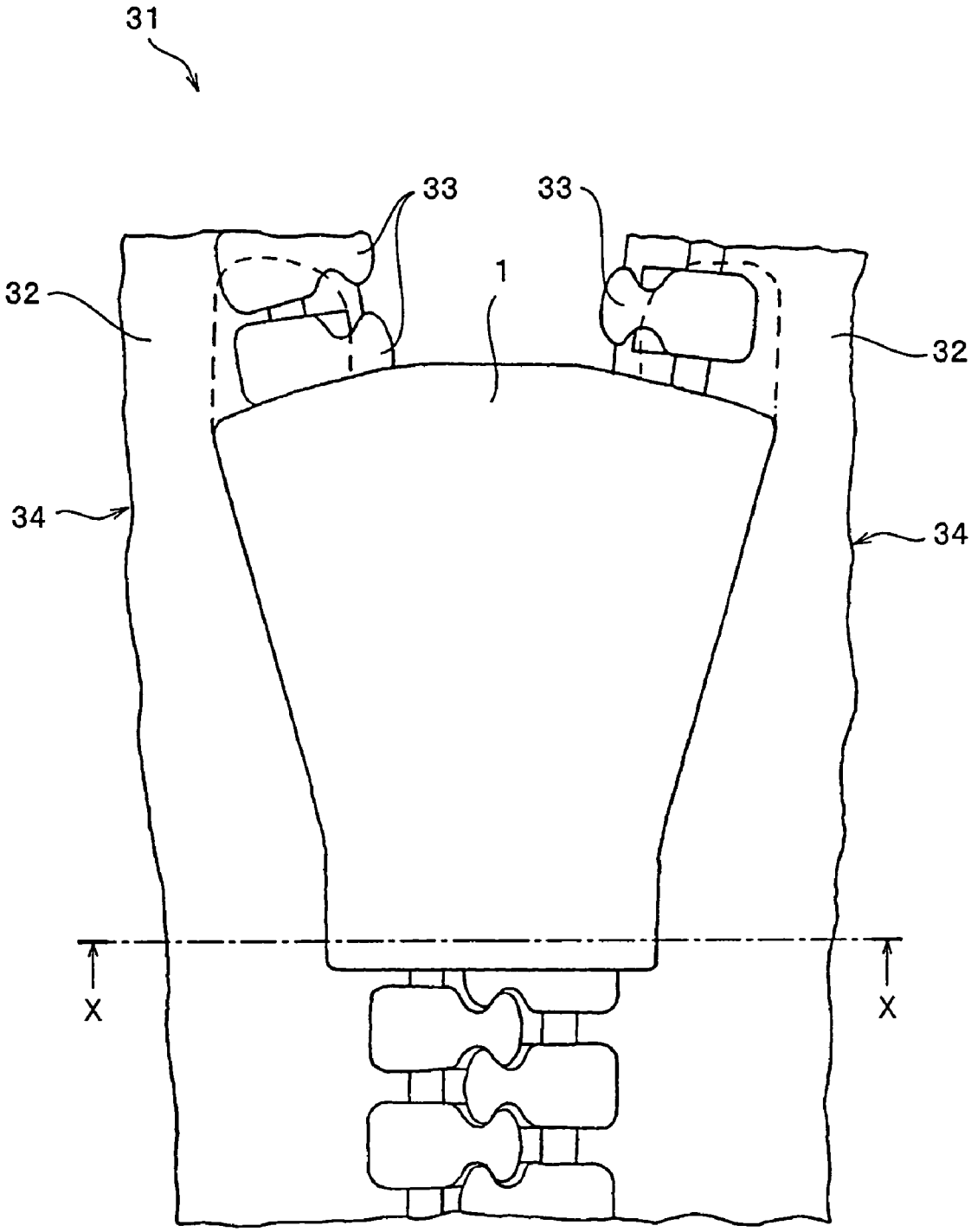
FIG. 9 is a rear view of the concealed type slide fastener as seen from a rear side of a tape.
Figure 10:
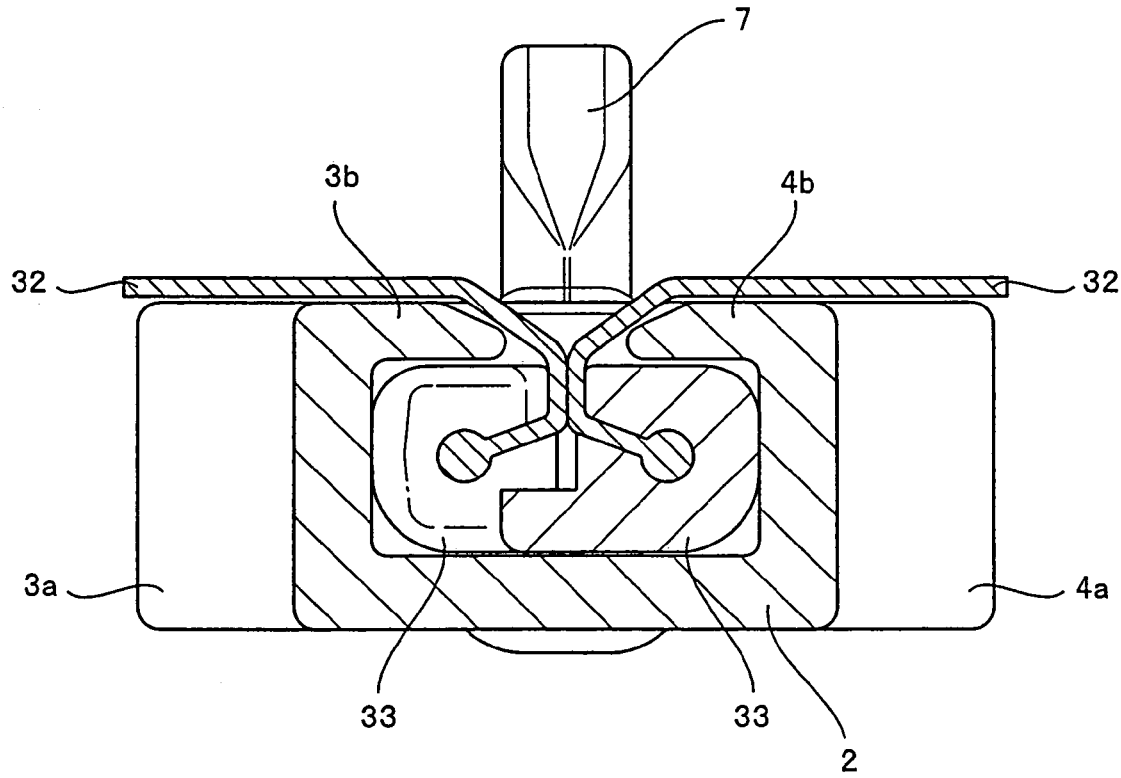
FIG. 10 is a sectional view taken along the line X-X of FIG. 9.

The respective fastener elements 33 are provided independently on element attachment edge portions opposing each other of the pair of fastener tapes 32 at a predetermined interval by injection molding to thereby form the fastener stringer 34. Thereafter, the element attachment edge of the fastener stringer 34 is folded back into a substantially U shape, and the folding shape is fixed by thermal setting. In this state, the slider 1 of the first embodiment described above is inserted in the element row of such fastener elements 33. As a consequence, the concealed type slide fastener 31 shown in FIG. 9 can be obtained. In the meantime, FIG. 9 is a rear view of the concealed type slide fastener 31 as seen from the rear side of the tape. FIG. 10 is a sectional view taken along the line X-X of FIG. 9.

If the slider 1 of the first embodiment is used in the concealed type slide fastener 31, the coupling head 35 of the element 33 is never nipped by a gap formed between the element guide portion 6 and the inside end face 10 of the right and left upper plate portions 3*b*, 4*b* even if a strong laterally pulling force is applied to the right and left fastener stringers 34 as described below with reference to FIGS. 5 to 8 when the concealed type slide fastener 31 is closed by sliding the slider 1. As a consequence, the concealed type slide fastener 31 can be closed without any trouble by sliding the slider 1 smoothly. This will be described more in detail with reference to FIGS. 5 to 8.

FIGS. 5 to 8 are respective sectional views taken along the lines V-V, VI-VI, VII-VII and VIII-VIII when the slider 1 shown in FIG. 2 is inserted in the element row of the fastener stringer 34. The respective drawings explain changes of the posture of the element step by step.

If the concealed type slide fastener 31 is applied to a seat cover of a passenger seat of automobile or the like, the concealed type slide fastener 31 is opened widely because it receives a strong laterally pulling force of pulling the right and left fastener stringers 34 outwardly as described above. In this case, the element 33 existing apart in a forward direction from the slider 1 in the engagement direction takes such a posture in which it is raised with the coupling head 35 up, and any element existing further forward may be inverted by 180 degrees from the engagement posture.

To close the concealed type slide fastener 31 in such a state, first, the element and fastener tape in the raised posture are brought into a contact with the front end portions of the parallel portions 21 of the upper plate portions 3*b*, 4*b* extended forward of the slider 1 by sliding the slider 1 in the engagement direction.

When the element in such a raised state is brought into a contact with the parallel portions 21 of the upper plate portions 3*b*, 4*b* extending forward, it receives a force of tilting by the element 33 already introduced into the element guide passage 14 of the slider 1 and tilted (or being tilted) and a relative pulling force of the fastener tape 33 based on the sliding operation of the slider 1. As a result, the right and left elements 33 making contact with the parallel portions 21 of the upper plate portions 3*b*, 4*b* are tilted gradually from a posture in which it is raised at right angle as it approaches the element guide portion 6 of the slider 1 (see FIG. 5).

In the first embodiment, the force of tilting the elements by the right and left preceding elements 33 (and the fastener tapes 32) is not so large because the respective elements are formed independently by injection molding. However, the right and left elements 33 are brought into contact with the parallel portions 21, whereby the raised elements can be tilted gradually by this tilting force and the relative pulling force. At the same time, the right and left elements 33 in contact with the upper plate portions 3*b*, 4*b* are introduced to the central portion of the slider 1 including the erected diamond 5 under a guide of the upper plate portions 3*b*, 4*b*.

Subsequently, the right and left elements 33 are guided up to the front end of the diamond 5 while the elements are kept in contact with the upper plate portions 3*b*, 4 *b* projecting forward. As a consequence, the elements 33 can be introduced smoothly into the element guide passage 14 of the slider 1 in a state in which the right and left elements 33 are tilted at a predetermined angle, and at the same time, the coupling head 35 of the element 33 can be brought into contact with the guide face 13 of the element guide portion 6. Particularly, according to the first embodiment, the right and left inside end faces 10 of the parallel portions 21 of the upper plate portions 3*b*, 4*b* are formed substantially in parallel, so that the coupling head 35 of the element 33 guided by the parallel portion 21 can be securely brought into a contact with the guide face 13 in the vicinity of the front end of the element guide portion 6.

Figure 7:
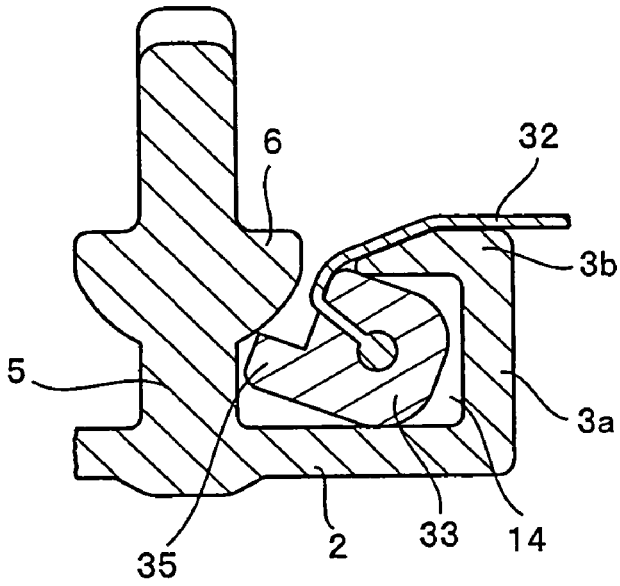
FIG. 7 is a sectional view taken along the line VII-VII of FIG. 2 when the slider shown in FIG. 2 is loaded on the element row of the fastener stringer.

When the slider 1 is slid, the element 33 running through the element guide passage 14 receives forces of tilting by the preceding element 33 and the fastener tape 32 and the guide by the guide face 13 of the element guide portion 6 as shown in FIG. 7, although it still receives the strong laterally pulling force. As a consequence, the coupling head 35 of the element 33 moves downward and approaches the lower plate 2, so that the element 33 is tilted further.

Figure 8:
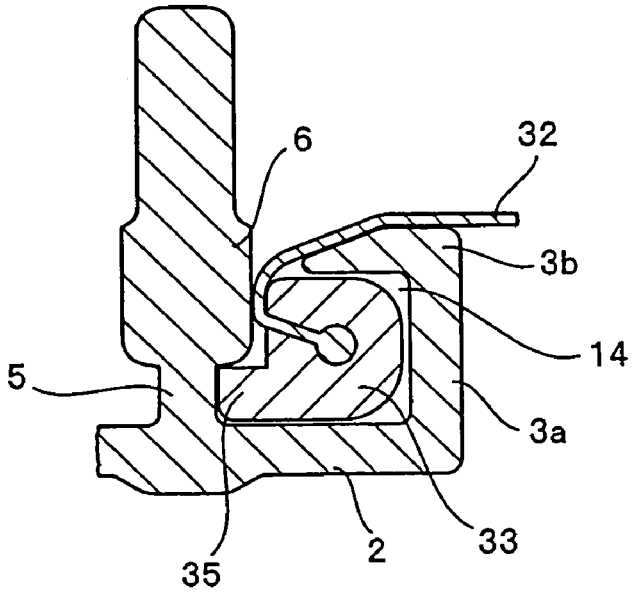
FIG. 8 is a sectional view taken along the line VIII-VIII of FIG. 2 when the slider shown in FIG. 2 is loaded on the element row of the fastener stringer.

When the element 33 runs further toward the rear mouth through the element guide passage 14, the right and left elements 33 can be changed to a required tilting posture (engagement posture) necessary for engagement of the right and left elements 33 as shown in FIG. 8. At the same time, the right and left elements 33 are introduced by the narrowed portion 22 of the upper plate portions 3*b*, 4*b*, the side walls 3*a*, 4*a* and the element guide portion 6, so that they approach each other as they advance to the rear mouth of the slider 1. When the right and left elements 33 are guided backward of the rear end of the element guide portion 6, the coupling heads 35 can be engaged stably.

In the slider 1 of the first embodiment, the right and left elements 33 can be tilted appropriately before they are introduced into the element guide passage 14 of the slider 1 even if the respective elements 44 are raised at right angle prior to engagement of the elements by receiving the laterally pulling force when the concealed type slide fastener 31 in which the elements 33 are attached by injection molding is closed and brought close to the diamond 5 so as to bring the coupling head 35 of the element 33 into a secure contact with the guide face 13 of the element guide portion 6.

Consequently, the respective elements 33 can be introduced into the element guide passage 14 of the slider 1 without being caught in between the element guide portion 6 and each of the flanges 3, 4. As a result, the right and left elements 33 can be tilted to a proper engagement posture and engaged with each other stably. Thus, even the concealed type slide fastener 31 in which respective elements 33 are attached independently can be closed without any trouble by a smooth sliding operation of the slider 1 with the elements 33 and the fastener tape 32 kept from being damaged and broken, respectively.

In the slider 1 of the first embodiment, as described above, the curved portions 11, 12 are formed on the inside opposing corner portions at the front end and rear end of the right and left upper plate portions 3*b*, 4*b*, and further, the tapered face 15 is formed on the top face of each of the right and left upper plate portions 3*b*, 4*b*. Consequently, even if the fastener stringers 34 receive a strong laterally pulling force when the concealed type slide fastener 31 is opened or closed by sliding the slider 1, the elements 33 and the fastener tape 32 can be prevented from being caught by the upper plate portions 3*b*, 4*b* because the upper plate portions 3*b*, 4*b* interfere with the elements 33 and the fastener tape 32. Thus, the sliding operation of the slider can be carried out smoothly.

The slider 1 of the first embodiment can be applied to a concealed type slide fastener equipped with coil-like elements effectively as well as the concealed type slide fastener in which the respective elements 33 are attached independently as described above. Consequently, the same effect can be obtained.

Figure 11:
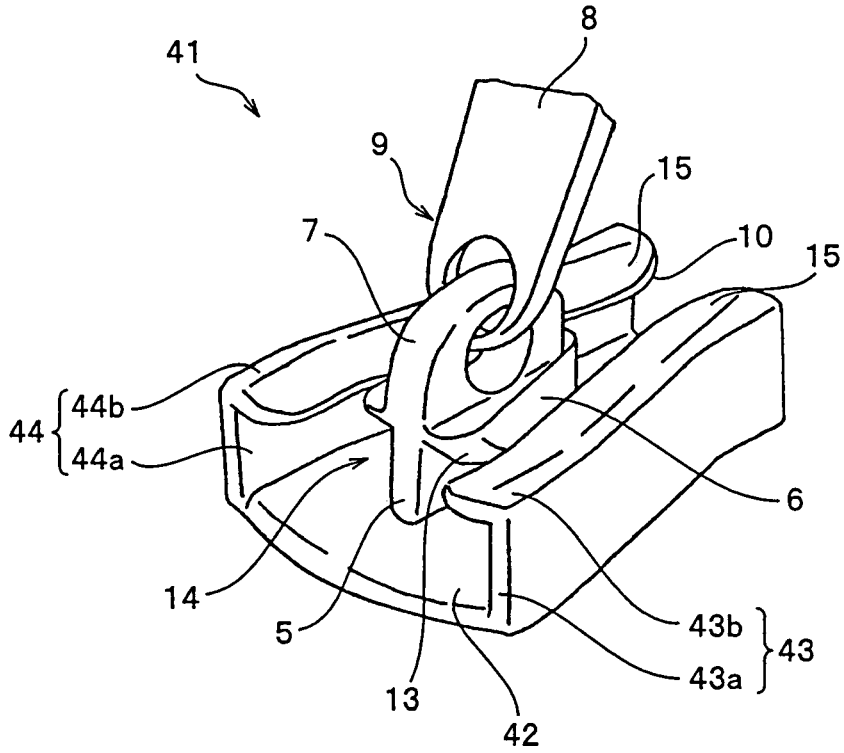
FIG. 11 is a perspective view of a slider for a concealed type slide fastener according to a second embodiment of the invention as seen from obliquely upward.
Figure 12:
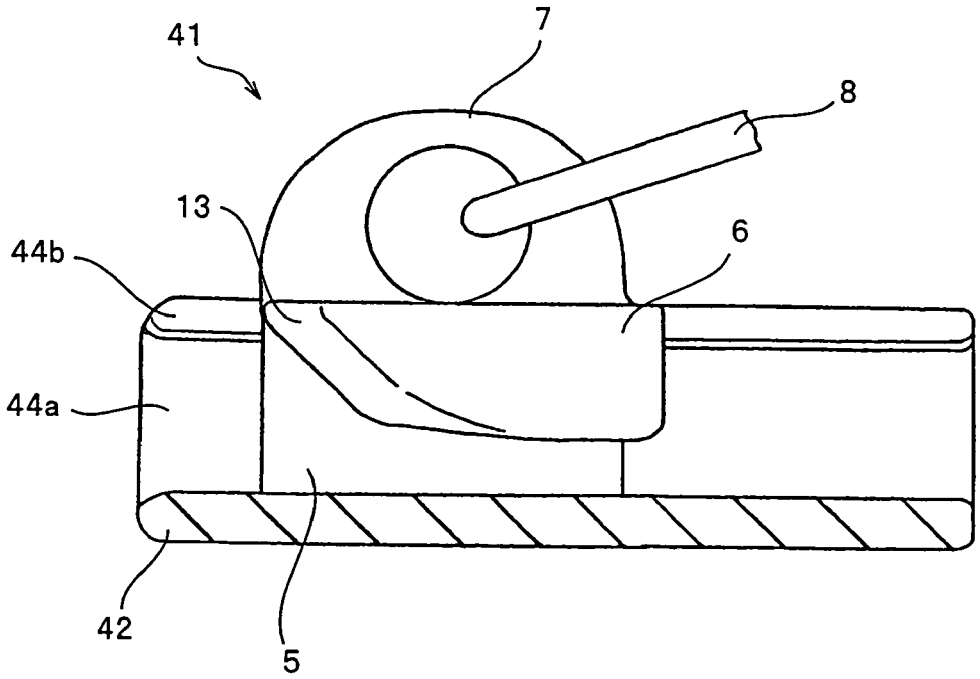
FIG. 12 is a partial sectional view of the slider as seen from sideway.

Next, a slider for a concealed type slide fastener according to a second embodiment of the present invention will be described. FIG. 11 is a perspective view of a slider 41 for a concealed type slide fastener according to the second embodiment as seen from obliquely upward. FIG. 12 is a sectional view of the slider 41 as seen from sideway. In the description of the second embodiment and in FIGS. 12 and 13, like reference numerals are attached to components having substantially the same configuration as the components described in the first embodiment, and description thereof is omitted.

In the slider 41 of the second embodiment, not only the front ends in the engagement direction of right and left upper plate portions 43*b*, 44*b* but also front ends in the engagement direction of a lower plate 42 and right and left side walls 43*a*, 44*a* are extended forward relative to the front end of the element guide portion 6. The other configuration is substantially not different from that of the first embodiment. In the second embodiment also, the same operation and effect as those of the first embodiment can be expected.

Assume that, in the slider 41 of the second embodiment, the fastener stringer is raised at right angle prior to engagement of the elements because it receives a laterally pulling force and brought close to the diamond 5 when the concealed type slide fastener is closed. In such a state, the right and left elements 33 can be tilted appropriately by the lower plate 42, the side walls 43*a*, 44*a* and the upper plate portions 43*b*, 44*b* extending forward of the front end of the element guide portion 6, and the coupling head 35 of the element 33 can be brought into a secure contact with the guide face 13 of the element guide portion 6.

Thus, the respective elements 33 can be introduced into the element guide passage 14 of the slider 41 without being caught in between the element guide portion 6 and each of the flanges 43, 44. As a consequence, the right and left elements 33 can be engaged stably after they are tilted to a proper engagement posture. Accordingly, the element 33 and the fastener tape 32 can be prevented from being damaged and broken, respectively, and the concealed type slide fastener 31 can be closed without any trouble by a smooth sliding operation of the slider 41.

The slider of the invention can be applied to the concealed type slide fastener, and more particularly, can be adapted effectively to a concealed type slide fastener in which the fastener stringer likely receives a strong laterally pulling force, like a concealed type slide fastener used for an automobile seat cover and the like.

What is claimed is:

1. A slider for a concealed slide fastener, the slider engaging/disengaging fastener elements of a pair of fastener stringers in which side edges opposing each other of fastener tapes are bent and fixed into a U shape and the fastener elements are attached along bent edges of the side edges, the slider includes:

a lower plate;

a pair of flanges each having an inverted L shaped section, the flanges comprising right and left side wall portions erected along side edges of the lower plate in a right and left direction perpendicular to a sliding direction of the slider and right and left upper plate portions extending from top ends of the right and left side wall portions in a direction of approaching each other;

a diamond erected from a central portion in a right and left direction near a shoulder mouth of the lower plate so as to be directed to a gap between the right and left upper plate portions; and element guide portions expanded outwardly toward inside end faces of the right and left upper plate portions from an outer periphery of the diamond, and wherein front ends of the upper plate portions in an engagement direction of the fastener elements are extended forward, compared with front ends of the element guide portions.

2. The slider for the concealed slide fastener according to claim 1, wherein the upper plate portions comprise:

parallel portions in which right and left inside end faces opposing each other are formed substantially in parallel along the engagement direction; and narrowed portions which extend backward of the parallel portions, in which a gap between the right and left inside end faces decreases gradually as it goes backward in the engagement direction.

3. The slider for the concealed slide fastener according to claim 2, wherein the element guide portions are expanded symmetrically in a right and left direction from the diamond toward the right and left upper plate portions, thickness of the element guide portions in the right and left direction temporarily and gradually increases as it goes from a front end to a rear end in the engagement direction, side edges of the element guide portions come close to the inside end faces of the parallel portions of the upper plate portions, and then, the thickness decreases gradually so that the side edges of the element guide portions become parallel to the inside end faces of the narrowed portions of the upper plate portions, the element guide portions have: intersection lines which are tilted or curved such that the thickness of the element guide portions decreases gradually as it goes downward in a height direction and which intersect with right and left side faces of the diamond; and guide faces formed on bottom portions of the element guide portions, from front ends to rear ends in the engagement direction, along the intersection lines, and the intersection lines are formed such that heights thereof with respect to a top face of the lower plate decreases gradually as they go from the front ends to the rear ends in the engagement direction.

4. The slider for the concealed slide fastener according to claim 3, wherein a border of the inside end faces between the parallel portions and the narrowed portions of the upper plate portions is located backward in the engagement direction, compared with a straight line connecting side edges of the element guide portions where the thickness of the element guide portions in the right and left direction is at maximum.

5. The slider for the concealed slide fastener according to claim 3, wherein a height of the intersection lines at the front ends in the engagement direction of the element guide portions from the top face of the lower plate is set larger than a height of the bottom faces of the upper plate portions.

6. The slider for the concealed slide fastener according to claim 1, wherein inside corner portions opposing each other at the front ends and rear ends in the engagement direction of the right and left upper plate portions are curved.

* * * * *